United States Patent [19]

Prouty et al.

[11] 4,207,988

[45] Jun. 17, 1980

[54] CLOSURES FOR CONTAINERS

[75] Inventors: Myron R. Prouty, Oakland; Colin J. Nichols, Burlingame; Norman A. Brown, Oakland; Stephen P. Sutter, Danville, all of Calif.

[73] Assignee: Cutter Laboratories, Inc., Berkeley, Calif.

[21] Appl. No.: 40,002

[22] Filed: May 18, 1979

[51] Int. Cl.[2] ..... B65D 41/50

[52] U.S. Cl. ..... 215/232; 215/249; 215/250; 215/256

[58] Field of Search ..... 215/247, 249, 248, 232, 215/250, 253, 256, 255

[56] References Cited

U.S. PATENT DOCUMENTS

| | | | |
|---|---|---|---|
| 3,394,831 | 7/1968 | Bathish | 215/249 |
| 3,545,638 | 12/1970 | Brown | 215/255 |
| 3,901,403 | 8/1975 | Menke | 215/251 |
| 4,046,276 | 9/1977 | Winchell | 215/250 |

*Primary Examiner*—Donald F. Norton

*Attorney, Agent, or Firm*—Robert E. Allen; Bertram Bradley; James A. Giblin

[57] ABSTRACT

Improvements in inner and outer closures for containers are disclosed. The outer closure is characterized by a cap member having a top wall, a side wall and a base adapted for sealing to the neck of a container. Two score lines extend across the top wall with finger gripping means attached at the apex where the two score lines meet. One score line extends down the side wall to connect with a third score line near the base which extends completely around the cap. The other score line extends down the side wall to an intermediate position and diverges away and terminates a short distance from the one score line. By pulling on the finger gripping means, the entire cap member above the third score line is removed in one piece. The inner closure comprises a plastic member sealed at its periphery to the mouth of the neck and includes a vertically aligned spike-entry port and an additive port which is oriented at an angle away from the entry port. The spike-entry port in an improved version comprises a spike-retaining collar which is joined to the body of the closure by a downward sloping web section which functions so as to cause the collar to grip an inserted spike more firmly to prevent accidental withdrawal of the spike. An improved version of an inner closure and container neck is also disclosed which includes particulate retaining means to prevent particulates formed during frictional welding of the closure to the neck from entering the container.

18 Claims, 10 Drawing Figures

CLOSURES FOR CONTAINERS

BACKGROUND OF THE INVENTION

1. Field

This invention relates to improvements in closures for containers, particularly for containers used for storing and dispensing sterile solutions and to a method for sealing the improved closures to a neck on the container.

2. Prior Art

For several years interest has been developing around flexible or semi-rigid plastic containers for storing and dispensing parenteral and irrigation solutions. Such containers have a number of advantages over glass containers in that they are less bulky, are not subject to shattering if dropped or bumped as are glass containers, and are more easily disposed. One of the main problems with plastic containers for such use was providing a closure system which would assure that entry sites would be maintained in a sterile condition prior to their connection with administration sets. One approach which appeared to provide such a closure system has been disclosed in U.S. Pat. No. 3,394,831. An inner closure having injection ports is sealed to the mouth of the neck on the container. The neck and inner closure are enclosed by an outer cap sealed at its base to an annular ledge on the neck whereby the outer cap maintains the sterility of the surface on the inner closure. Access to the inner closure is accomplished by pulling on a laterally projecting handle located between two grooves defining a tear strip on the side wall of the cap. Although this closure system accomplishes the purpose of maintaining sterility, there are several deficiencies associated with its design. The outer cap when removed often separates into two parts, i.e., the top and the strip portion, which can be a nuisance to the operator in disposing of these parts. The cap is difficult to remove because the pull must be made from the side of the cap. In addition the cap is difficult to mold and does not lend itself to being sealed to the neck by ultrasonic welding because of the obstruction by the handle.

U.S. Pat. Nos. 3,441,163 and 3,522,899 are representative of metal caps having a pull ring initiating a tear strip in the top surface. The score lines for the tear strip extend down the side, one extending to the bottom edge and the other only part way so that the cap is intended to be removed in one piece. These designs would be unacceptable for plastic caps; the tear strip would be severed completely from the cap since plastic tears more easily beyond an interrupted score line. The metal caps are also crimped around the neck of the container. This would be unacceptable for plastic caps since plastic tends to change shape under stress and thus a seal which assures sterility could not be achieved.

U.S. Pat. No. 3,545,638 also shows a metal cap of similar design except that the score line which extends only part way down the side terminates into a U-shape which is intended to prevent further tearing at this point and thus allows the entire cap to be removed. This cap is also compressed around the neck of the container and would not be acceptable if made of plastic.

U.S. Pat. No. 3,901,403 discloses a plastic closure having score lines in the top, one of which extends down the side or skirt portion part way to meet a circumferential score line. The entire top is first intended to be severed but remain joined to the skirt so that the skirt portion above the circumferential score line is also removed. The closure is made of material which is intended to elastically constrict around the neck of a bottle to provide a seal. This would be unacceptable for providing a seal assuring sterility. In addition, plastic closures having weakened zones for tearing in the top surface such as disclosed in this patent, are susceptible to having the tear strip sever from the top and leave the side intact.

Typical of a combination of inner and outer closure systems for parenteral solution containers in which the inner closure has two or more entry ports are those disclosed in U.S. Pat. Nos. 3,394,831, 3,905,368 and 3,921,630. In each instance the entry ports are parallel to each other. After the insertion of a spike of an administration set through one of two ports, the subsequent insertion of an additive solution or medicament through the adjacent port, particulary after the container has been suspended for delivery of the parenteral solution, is oftentimes awkward and difficult because the additive port can be obstructed by the administration spike and its associated drip chamber.

Spike entry ports with a rupturable membrane when made of plastic which is less resilient than elastomeric materials, sometimes do not retain a spike on an administration set when the solution container is in its inverted position. The ruptured membrane portion tends to push backwards on the spike to expel it. This problem can usually be corrected if the diameter of the port is made considerably smaller than the diameter of the spike. However, this is not a satisfactory solution since it becomes difficult to push the spike through the port.

With many plastic parenteral solution containers, in which an inner closure is sealed to the flange on the neck of the container by vibrational or ultrasonic welding techniques, particles of the plastic are often generated which then contaminate the solution in the container. This problem as well as the disadvantages enumerated above for inner and outer closures and spike ports have been overcome with containers of the present invention having improved inner and outer closures as herein disclosed.

SUMMARY OF THE INVENTION

The present invention relates to containers with an improved closure system, particularly plastic containers for storing and dispensing parenteral and irrigation solutions. Generally the container is characterized by a neck portion with an open mouth which is enclosed by an inner closure and with an outer closure hermetically sealed to the neck to maintain sterility of the inner closure prior to use.

In a preferred form, the outer closure comprises a plastic cap with a top wall, a side wall and a base, the base being hermetically sealed to an annular projection on the neck of the container below the mouth. The top wall has a tear section defined by two score lines which extend at least partially across the top and meet at a common junction. Finger grip means are located at this junction within the area defined by inner ends of the two score lines. One of the score lines extends to the edge of the top wall and diagonally down the side wall to meet a circumferential score line around the side wall above the base. The other score line extends only partly down the side wall and then curves into a short line generally parallel to the circumferential score line. By pulling upwardly and outwardly on the finger grip means, the plastic is ruptured at the score lines so that the entire cap above the circumferential score line is readily removed in one piece.

The outer closure can be sealed to the annular projection on the neck of the container by a variety of methods and, because of its particular design, lends itself to being sealed by ultrasonic welding, which method is not possible with outer closures of the type disclosed in U.S. Pat. No. 3,394,831.

The outer closure of this inventon can provide sterility protection for a variety of inner closures, including not only inner closures which have entry ports such as the inner closure which forms a part of this invention but also closures which include screw caps, for example.

The inner closure of the present invention comprises a plastic body member which has its peripheral edges sealed to the neck at the mouth of a plastic container and has two entry ports extending from the body member, the first one of which is closed by a pierceable membrane and extends perpendicularly with respect to the body member. The second entry port is closed by resealable means and extends at an angle with respect to the body member and in a position away from the first entry port. This unique arrangement of the two entry ports accomplishes several important objects; it greatly minimizes the chance for contaminating the entry surface of the adjacent port by fingers of an individual who introduces a spike of an administration set into the vertical port, or vice versa if a medicament is first introduced into the solution container through the angled port. Another distinct advantage is obtained when the container is inverted and suspended for delivery of the solution through the set. The introduction of a medicament via hypodermic syringe through the angled port is much more readily accomplished and in an unobstructed manner since the entry site is positioned away from the administration set spike and is more easily viewed by the operator.

Generally in the vertical entry port the rupturable membrane is integral with the walls of the port and is made of the same plastic which forms the inner closure. However, the port can also be closed by a membrane or plug of some other material retained within the port and capable of being ruptured by a spike. The angled port has an insert of resealable material, preferably an elastomeric material such as rubber. In a preferred form, this port also has an inner membrane which closes the port against contact of the solution in the container with the resealable insert.

A preferred form of the spike entry port is a distinct part of this invention and is applicable to any closure having a spike entry port. This preferred port structure comprises a spike-retaining collar which is integrally connected on its periphery to an upwardly sloping web. The outer edge of the web joins the supporting base of the closure. The collar includes a membrane across its lower end. A spike of an administration set can be easily pushed through the collar to penetrate the membrane but cannot be withdrawn without considerable force since such withdrawing action causes the web portion to bend towards the plane of the base which exerts pressure against the collar to tighten it around the spike.

The inner closure of this invention in combination with the mouth of the container can also have means for preventing plastic particulates from entering the container particularly during the process of sealing the closure to the mouth. It is characteristic that when two plastic parts are welded together by ultrasonic or vibrational procedures, particles of plastic are readily formed. As a feature of this invention, these particles are trapped by confining means located adjacent and inwardly of the sealing area on the periphery of the inner closure. More specifically, the inner closure periphery has a flat sealing surface for the weld on its outer edge, an intermediate recess and an inner tongue or projection. The container mouth has an outer flat surface to mate with the sealing surface of the closure, an intermediate tongue which is dimensionally narrower than the recess of the closure, and an inner ledge which rests against the inner tongue of the closure. When the inner closure is ultrasonically or vibrationally welded to the mouth of the container, any particles generated by this operation are effectively trapped by the tongues acting as barriers.

A better understanding of the features of this invention can be derived from the accompanying drawings and detailed descriptions of preferred embodiments.

DETAILED DESCRIPTION OF THE PREFERRED EMBODIMENT

Figure 1:
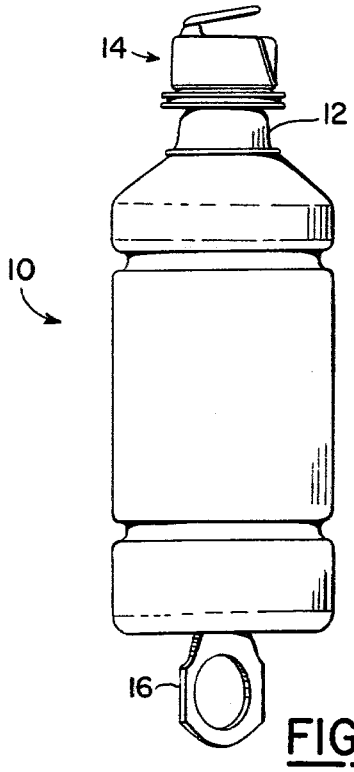
FIG. 1 illustrates a container whose neck portion is enclosed by an outer closure of this invention.
Figure 2:
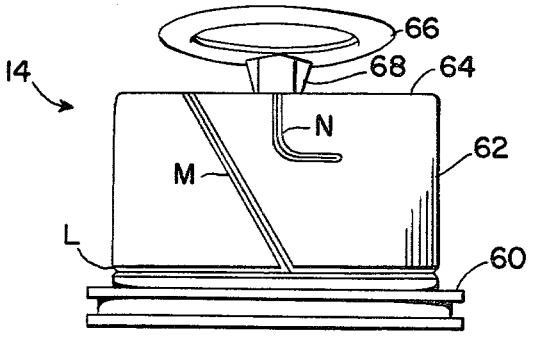
FIG. 2 is a side view of the outer closure in which score lines on a side wall are shown.
Figure 3:
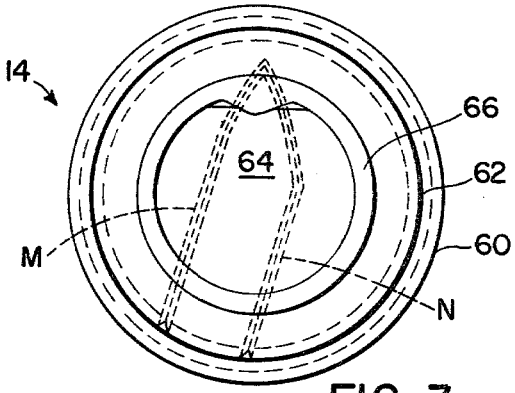
FIG. 3 is a top plan view of the outer closure of FIG. 2.

Referring to FIG. 1, a plastic container 10 for storing and dispensing parenteral solutions and the like is shown, having a neck portion 12 to which is sealed an outer closure 14, and a hanger 16 at the end of the container opposite its neck.

Inner closure 20, as shown in FIGS. 5 through 9, comprises a plastic body with a base wall 22, a side wall 24, and a peripheral ledge portion 26 extending outwardly from the side wall 24. The inner closure has a spike entry port 28 and an additive port 30, the former being generally perpendicular in relation to the ledge 26 and the latter being positioned at an angle so as to project away from port 28. The angle between ports 28 and 30 is not critical but an angle of about in the range of 20 to 45 degrees is desirable with 30 degrees being preferred.

Additive port 30, which may be used for the introduction of a solution containing a drug, vitamins, electrolytes or the like, has a resealable pad or disc 32 through which a spike or needle on an additive container can be made to penetrate. Port 30 may also have a membrane 34 to assist in supporting disc 32 as well as to prevent possible leaching of any extractives from disc 32 by the solution in container 10.

The configuration of spike entry port 28 is especially adapted for the retention of a spike once it has been positioned in the port. Port 28 is closed at its lower end by a membrane 36 through which the spike of an administration set may penetrate. A collar portion 38 adjacent membrane 36 is adapted to frictionally engage the shank of the spike but preferably its internal diameter should be of a size which does not present undue resistance while forcing the spike through collar 38 to penetrate membrane 36. The collar portion 38 of port 28 is connected to ledge 26 and side wall 24 by an annular web portion 40 in which the web slopes downwardly from the ledge to the collar. This sloping web imparts certain desirable properties to collar 38. It allows collar 38 to enlarge slightly as the spike is being forced through membrane 36 which makes for easier penetration. Then when the container 10 is in an inverted position for delivery of solution, any drag on the spike causes the web 40 to approach a horizontal position and this action compresses collar 38 to retain the spike more firmly. This effectively minimizes the possibility of the spike being disloged from the port.

Port 28 optionally may be closed at its open end by a cap 42 or some other means such as a peelable cover sealed over the opening.

Figure 5:
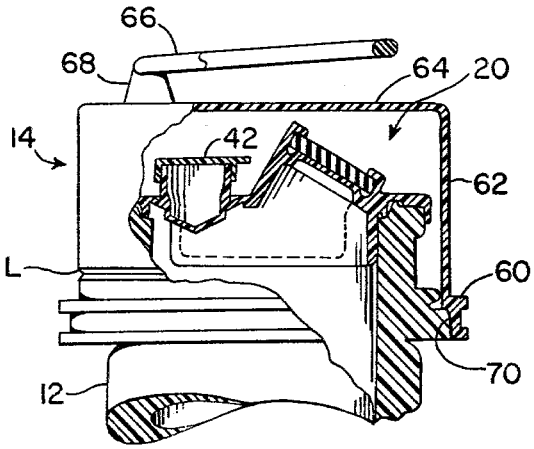
FIG. 5 is a side view in partial cross section illustrating the combination of inner and outer closures of this invention sealed to the neck of a container.
Figure 4:
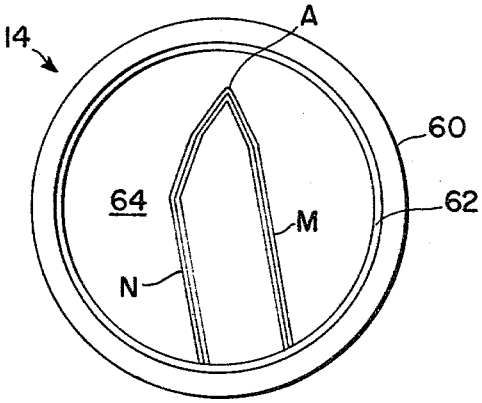
FIG. 4 is a bottom plan view of the outer closure of FIG. 2.
Figure 6:
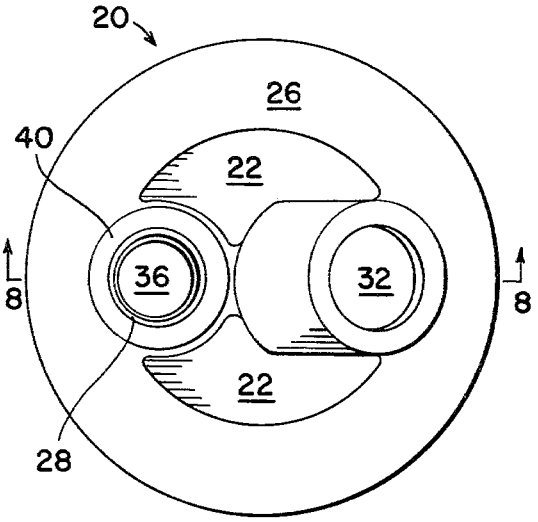
FIG. 6 is a top plan view of an embodiment of the inner closure of this invention.

The inner closure of this invention can have any means at its periphery which allows it to be sealingly engaged to the mouth on the neck of a container. However, the particular embodiment of the inner closure as shown in FIGS. 5, 8 and 9 illustrates a preferred configuration of the peripheral portion 26 which is designed to block any plastic particulates generated during the sealing operation from getting into the solution in the container.

Figure 8:
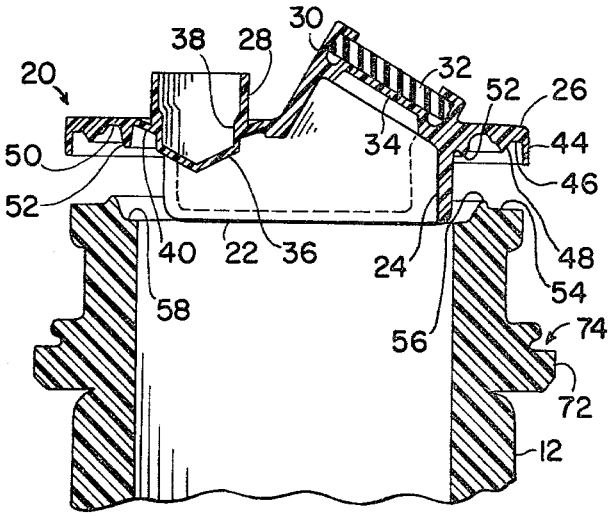
FIG. 8 is a side view in section of the neck portion of a container in relation to the inner closure prior to a sealing operation, the inner closure being in section taken along the line 8—8 of FIG. 6.
Figure 9:
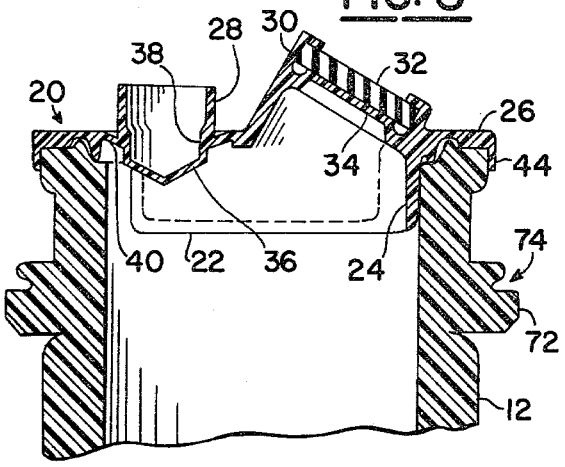
FIG. 9 is a view similar to FIG. 8 showing the inner closure sealed to the neck of the container.
Figure 7:
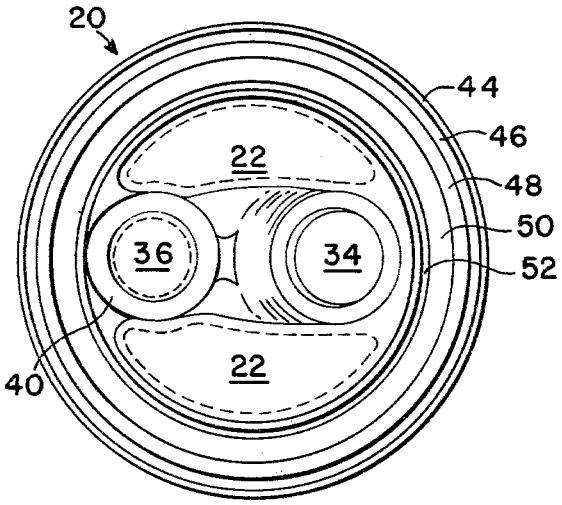
FIG. 7 is a bottom plan view of the inner closure of FIG. 6.

As best seen in FIG. 8, the peripheral portion 26 has at its outermost edge a downwardly extending projection 44, a sealing ledge 46 adjacent projection 44 on which is centered a triangular rib 48, a recess or groove 50 interrupting ledge 46, and a downwardly projecting tongue 52 inboard of groove 50. For sealing this particular peripheral portion to the rim on the neck 12 of a plastic container, the top surface of the rim is also designed so as to provide a configuration which, when sealed to the inner closure, results in blocking means for particulates. The rim has an outer ledge 54, an intermediate tongue or rib 56 and an inner shoulder 58. When ultrasonic or vibrational energy is directed on the top surface of peripheral portion 26 after the inner closure has been positioned over the rim on the neck of the container, rib 48 becomes molten and seals ledge 46 to ledge 54. At the same time, tongue 52 meets inner shoulder 58 and prevents any particulates generated during the sealing process which have moved into the recess 50 from going beyond the contact point between tongue 52 and shoulder 58. Intermediate rib 56, whose width is less than the width of groove or recess 50, moves into recess 50 but is dimensioned so that it does not quite meet or at most just meets the inner surface of recess 50. Its function is to act as a partial secondary barrier for particulates but its height should not be such that it would interfere with the generation of a seal between ledges 46 and 54 along at least most of their width.

The inner closure of this invention can be enclosed and protected from contamination by a variety of outer closures, any one of which has means for being hermetically sealed to the container neck and yet be readily removeable when access to the inner closure is desired. The outer closure of this invention is one which is particularly useful for this purpose.

Outer closure 14 as shown in FIGS. 2–5 comprises a base 60, a side wall 62 and a top wall 64. Score lines L, M, and N are formed by areas of reduced thickness in the top and side walls. Score line L extends all the way around the periphery of the side wall 62 near base 60. Score line M commences on the top 64 at a point A near the periphery, extends across top 64 and down side wall 62 to meet score line L. Preferably, score line M runs diagonally on side wall 62. Score line N starts at point A, also extends across top 64, continues part way down side wal1 62, then curves in a direction away from score line M and terminates a short distance from the curved portion. In the embodiment shown, score lines L, M and N are formed by grooves in which the grooves appear in the under surface of top wall 64 but are in the outer surface of side wall 62. The grooves can be in either surface, however, as long as thinned sections are produced which are rupturable.

A pull ring 66 connected by a post 68 to the top wall 64 at the point where score lines M and N meet provides the means for initiating rupture of the score lines. The base 60 of outer closure 14 is sealed at an inner edge 70 to an outer edge 72 of an annular flange 74 on neck 12 of the container 10. This seal is conveniently accomplished by spin-welding although other means for providing a hermetic seal can be used.

To remove that portion of the outer closure above score line L, one merely pulls on ring 66 to initiate rupture of score lines M and N at point A and by continued pulling of the ring, the rupture of score lines M and N progresses until the end of line N is reached and line M reaches score line L. Rupture of score line L then permits all the outer closure above line L to be removed in one piece. Access to ports 28 and 30 can then be made.

Figure 10:
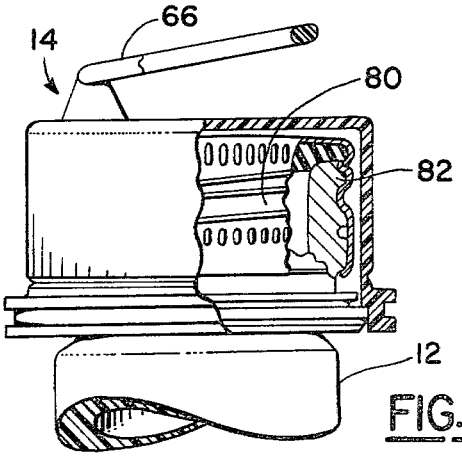
FIG. 10 is a side view in partial cross section showing the outer closure of the invention in combination with a screw cap inner closure.

Outer closure 14 can also be used on containers, such as a container for irrigation solutions as shown in FIG. 10, in which a screw-cap inner closure 80 provides a seal on mouth 82 of the container neck.

The outer closure and inner closure can be made of a variety of thermoplastic materials, preferably each being the same material as that of the container. One of the preferred materials is from a class of propylene and ethylene copolymers.

The above has been offered for illustrative purposes only and is not intended to limit the various features of this invention. Therefore the aim in the appended claims is to cover any changes and modifications which fall within the true spirit and scope of the invention.

What is claimed is:

1. A tear-open closure for enclosing a neck having an opening on a container comprising a cap having a base, a side wall and a top wall, the base having means for sealing engagement with an annular projection on the neck of the container below the opening, score lines defining rupturable thinned sections in the cap, said score lines including a first score line commencing at an intermediate point on the top wall and extending across the top wall and down the side wall to meet a second score line, said second score line extending circumferentially all the way around the side wall, a third score line joining the point where the first score line commences and extending across the top wall generally contiguous with the first score line when extending down the side wall and diverging from the first score line to terminate a short distance from the first score line at an intermediate point on the side wall substantially above the second score line; and finger gripping means projecting from the top wall adapted for initiating rupture of said first and third score lines at the point where they meet.

2. The closure of claim 1 wherein the first and third score lines are substantially parallel where they extend across the top wall and form an apex where they meet.

3. The closure of claim 2 wherein the first score line extends diagonally on the side wall to meet the second score line at an acute angle.

4. The closure of claim 3 wherein the second score line is parallel to and closely adjacent to the base.

5. The closure of claim 2 wherein the finger gripping means comprises a ring having a supporting post connecting the ring to the area on the top wall which forms the apex.

6. Apparatus for storing and dispensing a sterile solution which comprises a container having a neck with its open end sealed by a closure, an improvement in the closure comprising a transverse body closing the open end and having its peripheral edge portion sealingly engaging the neck at its open end, at least two entry ports positioned on the transverse body, one of said ports extending perpendicularly to the transverse body and having a rupturable membrane closing said one port, the other port extending angularly from the transverse body in a direction away from said one port, said other port being closed by resealable means.

7. The apparatus of claim 6 wherein the transverse body includes a side wall extending from a position inwardly from the area of the sealed edge and a base coextensive with the side wall.

8. The apparatus of claim 7 wherein the side wall extend into the neck of the container.

9. The apparatus of claim 6 wherein the resealable means associated with said other port includes a pad of resilient material.

10. The apparatus of claim 9 wherein said other port includes a rupturable membrane positioned below said pad.

11. The apparatus of claim 6 wherein said one port has a spike-engaging collar portion which is connected at its periphery by an annular web portion to the peripheral edge portion of the closure, the web portion sloping downwardly from the peripheral edge portion to the collar portion.

12. The apparatus of claims 6 or 11 further including an outer cap member enclosing the closure, the cap member being sealed to the neck of the container and having means operable to sever the cap member whereby at least an upper portion of the cap member can be removed to provide access to the closure,

13. Apparatus for storing and dispensing a sterile solution which comprises a container having a neck defining an open mouth and an annular projection on the outer wall of the neck below said mouth, an inner closure comprising a body member lying transversely across said mouth and sealingly engaged at its peripheral edges to the neck, a first entry port extending perpendicularly from said body member and having a rupturable membrane to close said first port, a second entry port including resealable means to close said second port, said second port extending angularly from said body member in a direction away from said first port, an outer closure comprising a cap member with a top wall, a side wall and a base, the base being sealingly engaged to the projection on the neck, score lines defining rupturable thinned sections in the cap, said score lines including a first score line commencing at an intermediate point on the top wall and extending across the top wall and diagonally down the side wall to meet a second score line, said second score line extending circumferentially adjacent the base all the way around the side wall, a third score line joining the point where the first score line commences and extending across the top wall generally parallel with the first score line then extending down the side wall and diverging from the first score line to terminate a short distance from the first score line at an intermediate point on the side wall substantially above the second score line; and finger gripping means projecting from the top wall adapted for initiating rupture of the first and third score lines at the point where they meet.

14. In a closure for an opening on a container in which the closure comprises a transverse body portion which includes a spike entry port, the port having a spike-engaging collar portion and a pierceable membrane below the collar portion which closes off the port, the improvement wherein the outer periphery of the collar portion is connected to the body portion by an annular web in which the web slopes downwardly from the body portion to the collar portion.

15. In a container having an opening in a neck portion with a closure frictionally welded to the mouth of the neck portion, the improvement wherein the closure has a peripheral portion whose undersurface is characterized by a generally flat welded area adjacent the outer edge of the peripheral portion, a groove inward from the welded area, and a tongue projecting downwardly between the groove and the inner edge of the peripheral portion; and the mouth of the container has a top surface which is characterized by a generally flat welded area adjacent the outer edge of the mouth which is contiguous with the welded area of the closure, an upwardly projecting rib intermediate on the top surface whose width is less than the width of the groove and whose length is substantially the same as the depth of the groove, and a shoulder between the rib and the inner edge of the mouth, the shoulder being of a depth that the tongue on the closure makes sealing contact with the shoulder when the closure is welded to the mouth of the container.

16. The container and closure of claim 15 wherein the outer edge of the closure has a rim which surrounds the outer edge of the mouth of the container.

17. The container and closure of claim 15 wherein the closure includes a spike entry port generally perpendicular to the peripheral portion and an additive port extending at an acute angle in a direction away from the spike entry port.

18. The container and closure of claim 17 wherein the spike entry port includes a spike-engaging collar which is surrounded by an annular web portion which is joined to the peripheral portion, the web portion being sloped downwardly from the peripheral portion to the collar.

* * * * *

UNITED STATES PATENT AND TRADEMARK OFFICE

CERTIFICATE OF CORRECTION

PATENT NO. : 4,207,988

DATED : June 17, 1980

INVENTOR(S) : Myron R. Prouty et al.

It is certified that error appears in the above—identified patent and that said Letters Patent is hereby corrected as shown below:

Column 5, line 26, "disloged" should read -- dislodged --.

Column 7, line 55, "," should read -- . --.

Signed and Sealed this

*Nineteenth* Day of *August 1980*

[SEAL]

*Attest:*

SIDNEY A. DIAMOND

*Attesting Officer*

*Commissioner of Patents and Trademark*